US009038693B2

(12) United States Patent
Gonzales et al.

(10) Patent No.: US 9,038,693 B2
(45) Date of Patent: May 26, 2015

(54) BARRIER SYSTEMS AND ASSOCIATED METHODS, INCLUDING VAPOR AND/OR BARRIER SYSTEMS WITH MANUAL EGRESS

(71) Applicant: Smoke Guard, Inc., Boise, ID (US)

(72) Inventors: Curtis Paul Gonzales, Eagle, ID (US); William L. Ziegert, Boise, ID (US); Paul R. Walters, Jr., Meridian, ID (US); Ben Tolman, Meridian, ID (US)

(73) Assignee: Smoke Guard, Inc., Boise, ID (US)

( * ) Notice: Subject to any disclaimer, the term of this patent is extended or adjusted under 35 U.S.C. 154(b) by 0 days.

(21) Appl. No.: 13/934,108

(22) Filed: Jul. 2, 2013

(65) Prior Publication Data

US 2014/0076502 A1 Mar. 20, 2014

Related U.S. Application Data

(63) Continuation of application No. 12/750,552, filed on Mar. 30, 2010, now abandoned.

(60) Provisional application No. 61/164,876, filed on Mar. 30, 2009.

(51) Int. Cl.

| | |
|---|---|
| ***E06B 9/68*** | (2006.01) |
| ***A62C 2/24*** | (2006.01) |
| ***A62C 2/10*** | (2006.01) |
| ***A62C 37/40*** | (2006.01) |
| ***E06B 9/13*** | (2006.01) |
| ***A62C 37/42*** | (2006.01) |
| ***E05F 15/20*** | (2006.01) |

(52) U.S. Cl.

CPC ..... *A62C 2/241* (2013.01); *E06B 2009/6818* (2013.01); *A62C 2/10* (2013.01); *A62C 2/24* (2013.01); *A62C 37/40* (2013.01); *E06B 9/13* (2013.01); *A62C 37/42* (2013.01); *E05F 15/2015* (2013.01); *E05F 15/72* (2015.01)

(58) Field of Classification Search

USPC ..... 160/7; 49/139, 140; 192/145

IPC ..... E06B 9/74,9/80, 9/82, 9/84, 2009/6809, E06B 2009/6818, 2009/82

See application file for complete search history.

(56) References Cited

U.S. PATENT DOCUMENTS

| | | | | |
|---|---|---|---|---|
| 5,022,452 | A * | 6/1991 | Burrell | 160/7 |
| 5,576,581 | A * | 11/1996 | Iannuzzi et al. | 307/117 |
| 5,896,907 | A * | 4/1999 | Dever et al. | 160/6 |
| 6,155,324 | A * | 12/2000 | Elliott et al. | 160/1 |
| 6,484,784 | B1 * | 11/2002 | Weik et al. | 160/7 |
| 6,924,730 | B1 * | 8/2005 | Evans | 340/286.05 |
| 8,307,877 | B1 * | 11/2012 | Lambridis et al. | 160/118 |
| 8,505,241 | B2 * | 8/2013 | Kusunoki | 49/360 |
| 2004/0123525 | A1 * | 7/2004 | Suzuki et al. | 49/360 |
| 2010/0005723 | A1 * | 1/2010 | Evans | 49/322 |

* cited by examiner

*Primary Examiner* — David Purol

(74) *Attorney, Agent, or Firm* — Perkins Coie LLP

(57) ABSTRACT

Barrier systems and associated methods, including vapor and/or fire barrier systems, are disclosed herein. One aspect of the invention is directed toward a barrier system that includes a barrier coupled to a spool, and a drive system. The barrier is positioned to be wound onto and off of the spool as the barrier moves between a deployed position and a retracted position by the drive assembly. The system further includes a clutch configured to resist movement of the barrier system unless directed by the drive system, and to release the barrier to allow manual egress when power to the drive system fails. The system further includes a latch configured to retain the barrier in a retracted position and to prevent the barrier from deploying when power fails and the clutch releases.

18 Claims, 7 Drawing Sheets

BARRIER SYSTEMS AND ASSOCIATED METHODS, INCLUDING VAPOR AND/OR BARRIER SYSTEMS WITH MANUAL EGRESS

CROSS-REFERENCE TO RELATED APPLICATIONS

This application is a continuation of U.S. patent application Ser. No. 12/750,552, filed Mar. 30, 2010 and titled BARRIER SYSTEMS AND ASSOCIATED METHODS, INCLUDING VAPOR AND/OR BARRIER SYSTEMS WITH MANUAL EGRESS, which claims priority to U.S. Provisional Patent Application No. 61/164,876, filed Mar. 30, 2009 and titled BARRIER SYSTEMS AND ASSOCIATED METHODS, INCLUDING VAPOR AND/OR BARRIER SYSTEMS WITH MANUAL EGRESS, all of which are incorporated herein in their entirety by reference thereto.

TECHNICAL FIELD

Embodiments of the present invention relate to barrier systems and associated methods, including vapor and/or fire barrier systems.

BACKGROUND

Smoke, fumes, and noxious gasses can be very dangerous to occupants during a building fire. It is well known that many fire-related deaths are the result of smoke inhalation. During a fire, or an event where dangerous gases may be present, fumes are likely to travel very quickly through paths that offer little resistance. Paths such as elevator shafts are often well drafted and provide an excellent avenue by which smoke and other dangerous gases can rapidly travel to otherwise unaffected areas of a building. To prevent such a migration of dangerous gases, many devices and assemblies have been designed to limit the dispersal of such fumes by cutting off possible paths or openings. Examples of such devices are smoke screen assemblies disclosed in U.S. Pat. No. 5,383,510, entitled APPARATUS AND METHOD FOR RAPIDLY AND RELIABLY SEALING OFF CERTAIN OPENINGS IN RESPONSE TO SMOKE, NOXIOUS FUMES OR CONTAMINATED AIR, issued Jan. 24, 1995; U.S. Pat. No. 5,195,594, entitled APPARATUS AND METHOD FOR RAPIDLY AND RELIABLY SEALING OFF CERTAIN EXIT AND ENTRANCE WAYS IN RESPONSE TO SMOKE OR FIRE, issued Mar. 23, 1993; U.S. Pat. No. 7,000,668, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Feb. 21, 2006; U.S. Pat. No. 7,028,742, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Apr. 18, 2006; and U.S. Patent Application No. 2006/0226103, entitled CLOSING MEMBER CONTROL SYSTEMS, INCLUDING DOOR CONTROL SYSTEMS FOR BARRIER HOUSINGS, AND ASSOCIATED METHODS, filed Oct. 12, 2006; each of which is incorporated herein by reference in its entirety.

SUMMARY

The present invention provides a barrier system and related methods that overcome drawbacks experienced in the prior art and provides additional benefits. In accordance with at least one embodiment, a smoke barrier system usable adjacent to a passageway in a structure if provided that comprises: a smoke barrier configured to move between a deployed position covering the passageway and a retracted position not covering the passageway; a drive system configured to acitvely drive the smoke barrier toward each of the deployed position and the retracted position; and a clutch operably interconnecting the drive system and the smoke barrier, the clutch being movable between engaged and released positions, in the engaged position the clutch interconnects the drive system with the barrier to allow the drive system to actively drive the smoke barrier to and from the deployed position during a first condition, and wherein the drive system restricts manual movement of the smoke barrier away from the deployed position when the clutch is in the engaged position, and in the released position the clutch disconnects the drive system from the smoke barrier during a second condition and the smoke barrier will remain in at least one of the deployed position and an intermediate position between the deployed and retracted positions independent of operation of the drive system, and the smoke barrier is manually movable to and from the deployed position independent of operation of the drive system.

In another embodiment a barrier system is provided that comprised: a spool positioned in a housing with a flexible barrier coupled to the spool, the barrier being configured to deploy by winding onto and off of the spool when the spool rotates; a drive system configured to activate in response to an activation signal and to rotate the spool to deploy the barrier when active, wherein the drive system comprises a clutch configured to resist rotation not initiated by the drive system, and wherein the clutch is configured to release the spool when power to the drive system is unavailable; and a biasing manual assist member coupled to the barrier in an energized position when the barrier is deployed such that when power is unavailable the biasing member urges the barrier toward the spool when the clutch is in the released position and during manual movement of the smoke barrier away from a deployed position.

In another embodiment, a vapor passage inhibition system usable adjacent to a passageway in a structure is provided that comprises: means for detecting the presence of at least one harmful vapor; barrier configured to move between a deployed position covering the passageway and a retracted position not covering the passageway; means for driving the barrier toward each of the deployed position and the retracted position, wherein the barrier is driven toward the deployed position in response to a detected condition potentially related to presence of at least one harmful vapor; and means for coupling the means for driving to the barrier, wherein the means for coupling is configured to release the means for driving only when power to the means for driving is unavailable and to allow manual movement of the barrier away from the deployed position.

In another embodiment, a method of inhibiting passage of vapor through a passageway is provided that comprises: receiving an activation signal; actuating a powered drive system to deploy a barrier into the passageway in response to the activation signal, wherein the drive system comprises a clutch configured to resist movement of the barrier except as directed by the drive system; and releasing the clutch when power to the drive system is unavailable, such that the barrier may be manually moved independent of operation of the drive system.

DETAILED DESCRIPTION

Figure 1:
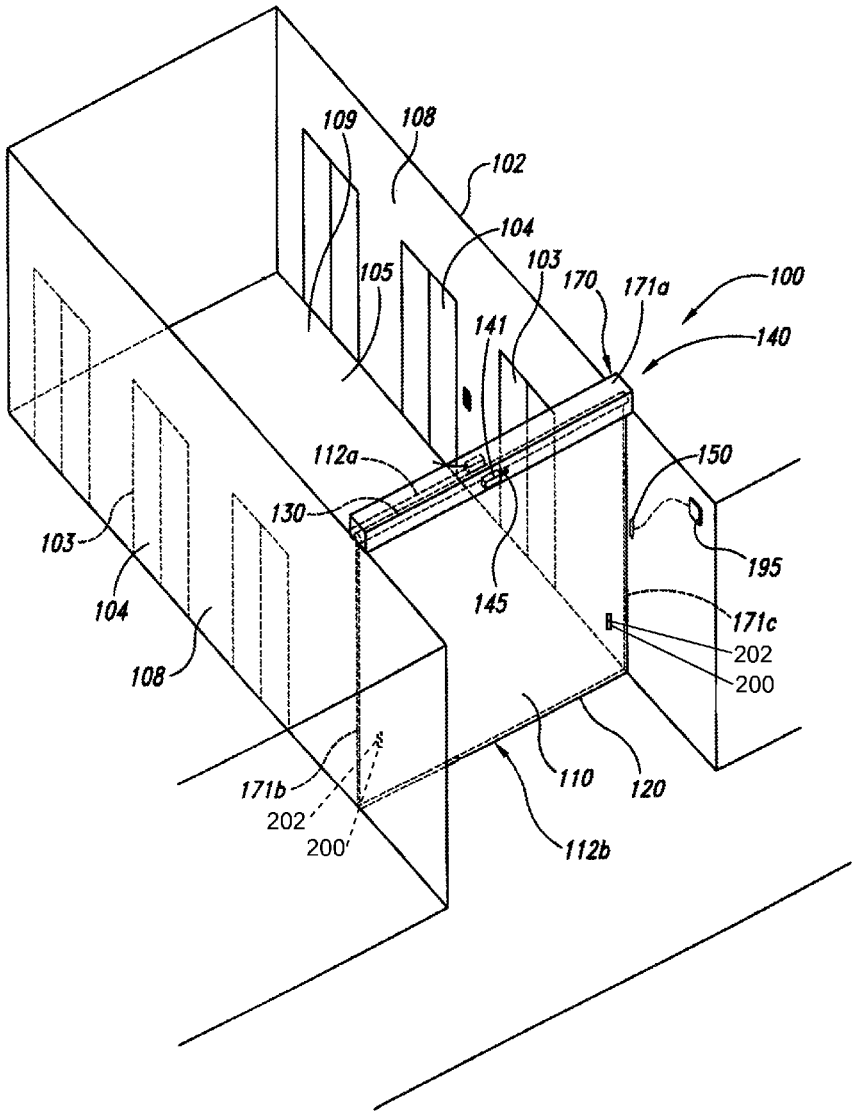
FIG. 1 is an isometric illustration of a barrier system in accordance with embodiments of the invention.

Aspects of the present invention are directed generally toward barrier systems and associated methods, including vapor and/or fire barrier systems. One aspect of the invention is directed toward a barrier system that includes a barrier movable between a deployed position and a retracted position. The system further includes a drive system configured to move the barrier between the deployed position and the retracted position, and a power source configured to supply power to the drive system. A clutch connects the drive system and the barrier, and releases the barrier when the power source is unavailable. The system also includes a latch that closes when the barrier is in the retracted position and retains the barrier in the retracted position.

Other aspects of the invention are directed toward a barrier system including a spool positioned in a housing with a flexible barrier coupled to the spool, the barrier deploys by winding onto and off of the spool when the spool rotates. The system further includes a drive system configured to activate in response to an activation signal and to rotate the spool to deploy the barrier when active. The drive system includes a clutch that resists rotation not initiated by the drive system. The clutch is configured to release the spool when power to the drive system fails. A latch is positioned between a portion of the barrier and the housing to retain the spool in a retracted position within the housing such that the spool will not rotate and deploy the barrier when power fails and the drive system is inactive, and wherein the latch is configured to release and permit the barrier to deploy when the drive system is powered and the drive system is active.

Still other aspects of the invention are directed toward a method of inhibiting passage of vapor through a passageway. The method includes receiving an activation signal, and actuating a powered drive system to deploy a barrier into the passageway in response to the activation signal. The drive system includes a clutch that resists movement of the barrier except as directed by the drive system. The method further includes releasing the clutch when power to the drive system fails such that the barrier can be moved without direction from the drive system when power fails.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section. As used herein, the term "vapor" includes but is not limited to gases or gases carrying particulates (e.g., solid and/or liquid particulates), such as smoke, fumes, smoke with soot particles, contaminated air, noxious fumes, and/or the like.

References throughout the specification to "one embodiment" or "an embodiment" means that a particular feature, structure, or characteristic described in connection with the embodiment and included in at least one embodiment of the present invention. Thus, the appearances of the phrase "in one embodiment" or "in an embodiment" in various places throughout the specification are not necessarily all referring to the same embodiment. Furthermore, the particular features, structures, or characteristics may be combined in any suitable manner in one or more embodiments.

FIGS. 1-7 illustrate various features of a barrier system in accordance with various embodiments of the invention. FIG. 1 is an isometric illustration of the barrier system 100 that is located generally proximate to at least one passageway or opening 103 in a structure 102. In the illustrated embodiment, a plurality of openings 103 in the structure 102 are hoistway openings between elevator shafts and a hallway, such as an elevator lobby 105 on a floor 107 of a building. In FIG. 1, movable elevator doors 104 can prevent access to the shaft when an elevator car is not present. However, as mentioned above, in the event of a fire these elevator doors may not sufficiently prevent vapors and/or fire from migrating through the opening 103. Accordingly, in the illustrated embodiment the barrier system 100 is positioned to sealably extend across the elevator lobby between two opposing walls 108, when the barrier system 100 is in a deployed position (shown in FIG. 1), thereby substantially sealing off the elevator lobby 105 and the elevator shafts from the rest of the floor. For example, the barrier system 100 can be positioned to at least approximately seal a passageway or opening in the building structure between the elevator lobby and the rest of the floor. In other embodiments, the barrier system 100 can be positioned proximate to one or more of the opening(s) 103 so that in the deployed position the barrier system 100 at least approximately seals the associated elevator shaft(s) and the lobby 105 from one another.

In selected embodiments, the barrier system 100 includes a flexible barrier 110 that can include a fabric smoke barrier or curtain and/or a fire barrier or curtain and in the deployed position can resist the movement or migration of vapors and/or fire (e.g., flames, burning materials, high temperature gases, and/or the like) between the elevator lobby and the rest of the floor. When the barrier 110 is in a retracted position (shown in FIG. 2), the portion of the elevator lobby is unblocked allowing an individual to pass to and from the elevators.

In FIG. 1, the barrier system 100 includes a drive assembly 140 coupled to the flexible barrier 110 to enable movement of the barrier between the retracted and deployed position. For example, in selected embodiments the drive assembly 140 can apply a force to move the barrier 110 between the retracted and deployed position. In other embodiments, the drive assembly 140 can allow other forces to move the barrier 110 between the deployed and retracted position, for example, by at least partially releasing a force resisting the movement of the barrier 110.

The barrier system 100 includes a control system 150 coupled to the drive assembly 140 and configured to command movement or operation of the drive assembly 140, which in turn can control movement of the barrier 110. In FIG. 1, the control system 150 is also operably coupled to at least one external device 195 associated with the barrier system 100, such as a fire alarm/detector, a smoke alarm/detector, an external monitoring system that monitors and displays the status of the barrier system 100 (or provides remote control of the system), and/or the like.

In selected embodiments, the control system 150 can include a computing system or computer and can be configured with instructions to control the movement of the drive assembly, to control the movement of the barrier, to communicate with external devices 195, to perform various monitoring tasks, to provide or display the status of at least a portion of the barrier system 100, and/or the like. In certain embodiments, the control system 150 can include a display for displaying associated information and/or a control panel or key pad that allows a user to provide inputs to the control system 150 (e.g., to control the barrier system 100).

For example, in one embodiment the external device 195 can include a detector for detecting fire or selected vapor(s) (e.g., smoke). The detector can have at least two states including a first state where the detector does not sense the selected vapor(s) or fire (or where the detector senses the absence of the selected vapor(s) or fire) and a second state where the detector senses at least one of the selected vapor(s) and fire. The control system 150 can be configured to command the drive assembly 140 to enable movement of the barrier 110 toward the deployed position when the detector is in the second state. In certain embodiments, the control system 150 can be configured to command the drive assembly 140 to enable movement of the barrier 110 toward the retracted position when the detector is in the first state and the barrier 110 is not in the retracted position, for example, after the barrier 110 has been deployed in response to the detector sensing the selected vapor(s) and the selected vapor(s) have cleared.

Figure 2:
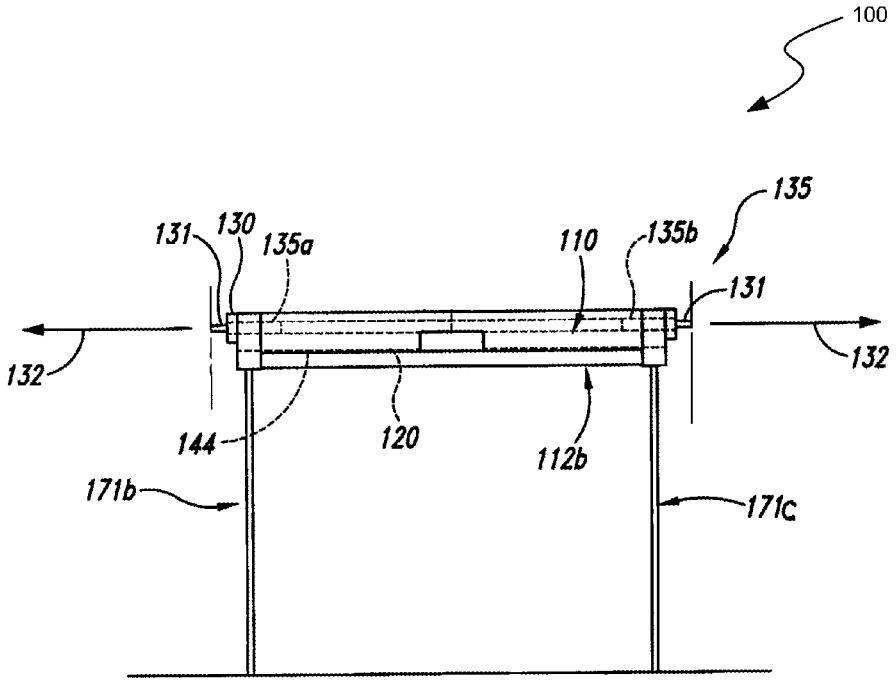
FIG. 2 is a partially schematic cross-sectional front elevation view of a portion of the barrier system shown in FIG. 1.

FIG. 2 is a partially schematic, cross-sectional front elevation view of a portion of the barrier system 100 shown in FIG. 1. In FIG. 2, a spool 130 is positioned at least partially within the upper portion 171*a*. In the illustrated embodiment the spool 130 is carried by the housing assembly 170 via one or more axles 131. As shown in FIG. 2, the spool 130 is coupled to a first end 112*a* of the barrier 110. Accordingly, barrier 110 is positioned to be wound onto the spool 130 as the barrier 110 moves toward the retracted position and off of the spool 130 as the barrier 110 move towards the deployed position.

For example, as shown in FIG. 2, the spool 130 can be carried by the housing assembly 170 so that the spool's axis of rotation 132 is fixed relative to the housing assembly 170 (e.g., the axles 131 are coupled to the housing 170 to rotate about a fixed position relative to the housing assembly 170) and/or fixed in space. In selected embodiments, the drive assembly 140 can be coupled to a second end 112*b* of the barrier 110 and configured to move or enable movement of the second end 112*b* of the barrier 110 away from the spool 130 toward the deployed position. As the second end 112*b* of the barrier moves away from the spool 130, the spool rotates and the barrier 110 is wound off of the spool 130. The drive assembly 140 is also configured to rotate the spool 130 in the opposite direction to positively wind the barriers onto the spool as the barrier moves from the deployed position toward the retracted position. In selected embodiments, the barrier system 100 can include one or more urging or resilient elements 135 (e.g., spring devices) coupled to the spool 130. In the illustrated embodiment, the barrier system 100 includes two resilient elements shown as a first resilient element 135*a* and a second resilient element 135*b*. The resilient elements 135 can have a rest position and can be configured so that when the resilient elements are displaced away from the rest position the resilient elements have a tendency to return to the rest position.

The spool can be coupled to the resilient elements 135 so that when the barrier 110 is wound off of the spool 130, the resilient elements 135 are displaced away from the rest position. Accordingly, as the barrier 110 is wound off of the spool 130, the resilient elements 135 can supply an urging force or can urge the spool to rotate in a manner that will wind the barrier 110 onto the spool 130. Therefore, in certain embodiments when the barrier 110 is not in the retracted position, the drive assembly 140 can move the second end 112*b* of the barrier 110 toward the spool (e.g., moving the barrier toward the retracted position) and the resilient elements 135 can apply an urging force to the spool 130 to aid in winding the barrier onto the spool 130. In other embodiments, the drive assembly 140 can enable movement of the barrier 110 toward the retracted position by releasing at least a portion of a force resisting the movement of the barrier toward the retracted position, thereby allowing the resilient elements 135 to wind the barrier 110 onto the spool 130. In other embodiments the drive assembly 140, barrier 110, and resilient elements 135 can have other arrangements. For example, in selected embodiments the barrier system 100 can include more or fewer resilient elements including no resilient elements. In other embodiments, the rest position of the resilient element(s) can be positioned so that the resilient element(s) are displaced away from the rest position when the barrier is moved toward the retracted position.

Figure 3:
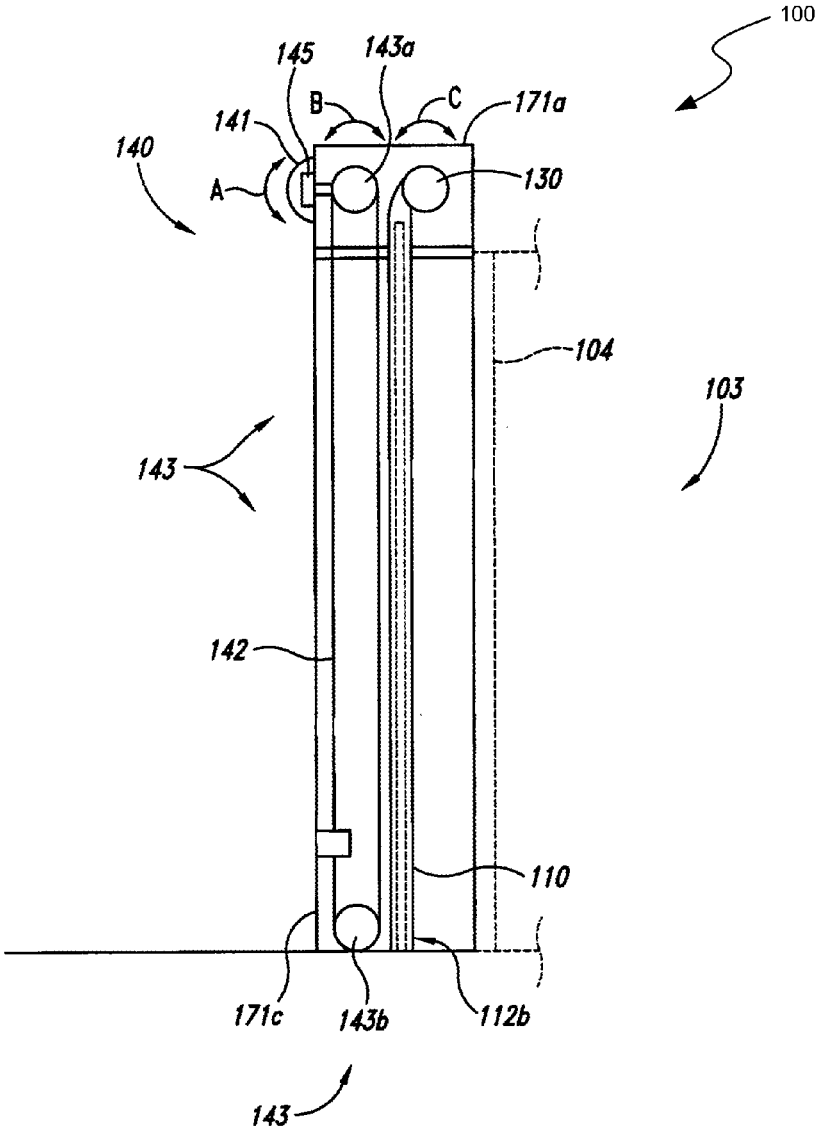
FIG. 3 is a partially schematic cross-sectional side elevation view of a portion of a drive assembly of the barrier system shown in FIG. 1.
Figure 4:
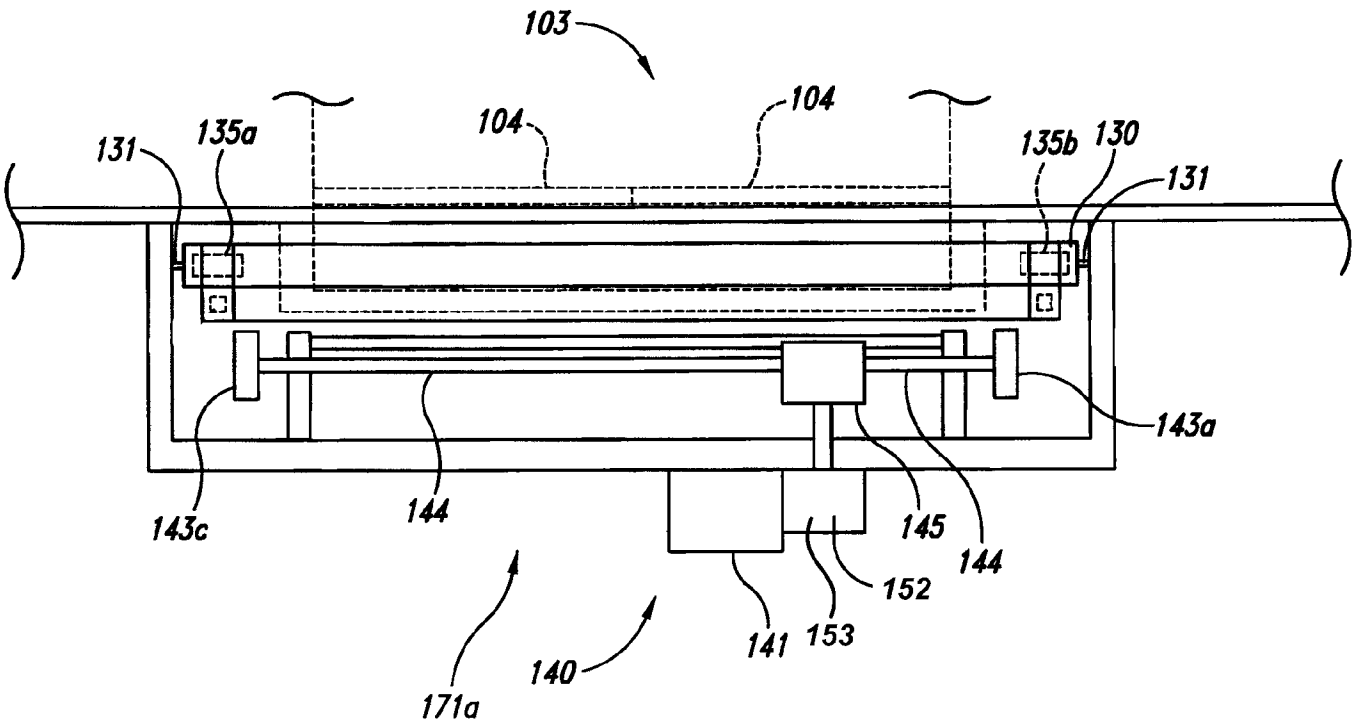
FIG. 4 is a partially schematic cross-sectional top view of a portion of the drive assembly of the barrier system shown in FIG. 1.
Figure 5:
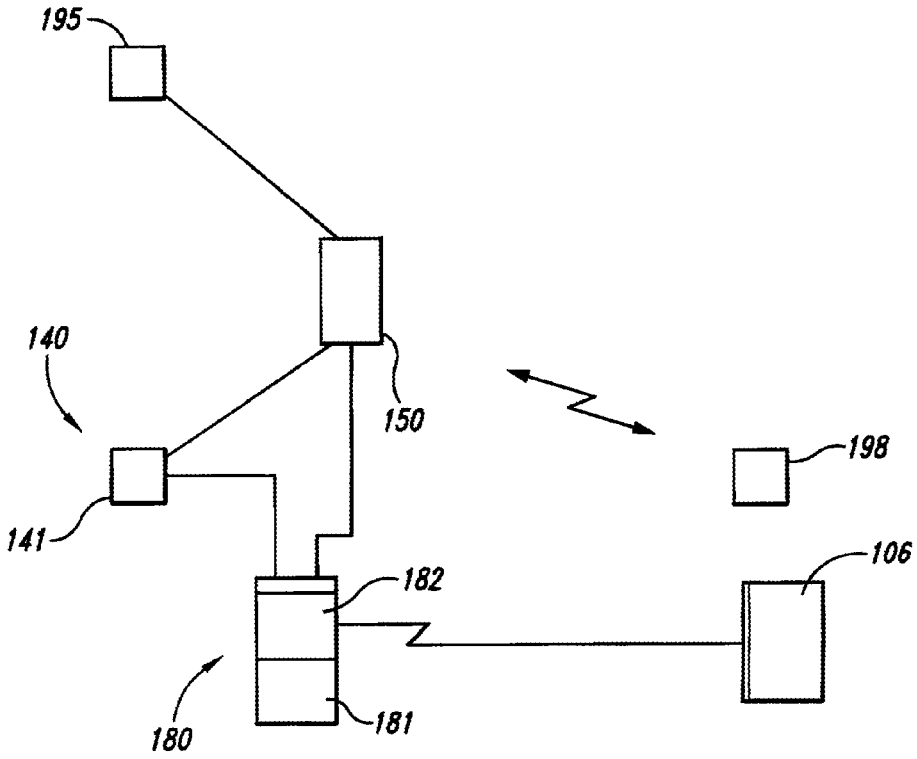
FIG. 5 is a partially schematic illustration of a portion of a control system and a power supply of the barrier system shown in FIG. 1.

FIG. 3 is a partially schematic cross-sectional side elevation view of a portion of the drive assembly 140 of the barrier system 100, and FIG. 4 is a partially schematic cross-sectional top view of a portion of the drive assembly 140. In the illustrated embodiment, the drive assembly 140 is configured to move the flexible barrier 110 relative to the elevator lobby 105 and/or relative to the housing assembly 170. In selected embodiments, the drive assembly 140 can include one or more motors 141, one or more belt devices 142, one or more rotational devices 143, one or more drive shafts 144, and one or more couplers 145. In the illustrated embodiment, the barrier system 100 includes two belt devices 142, one located within the first side portion 171*b* of the housing assembly 170 and one in the second side portion 171*c* of the housing assembly 170. The belt device 142 in the second side portion 171*c* of the housing 170 is shown in FIG. 5. In the illustrated embodiment, the second end 112*b* of the barrier 110 is coupled to the belt devices 142, for example, via one or more clamp devices, one or more coupling devices, and/or one or more fastener devices (not shown).

The belt devices 142 in the illustrated embodiment extend between rotational devices 143, such as a pulley, wheel, or other rotatable mechanism. For example, in FIG. 3 the belt device 142 located in the second side portion 171*c* is positioned on two rotational devices 143, shown as a first rotational device 143*a* located in the upper portion 171*a* of the housing assembly 170 and a second rotational device 143*b* located in the second side portion 171*c* of the housing assembly 170. The other belt device 142 located in the first side portion 171*a* is positioned in a similar manner on two rotational devices 143, including a third rotational device 143*c* located in the upper portion 171*a* of the housing assembly 170 and a fourth rotational device located in the first side portion 171*b* of the housing assembly 170.

As shown in FIG. 4, the first and third rotational devices 143*a* and 143*c* are coupled together by one or more drive shafts 144. The motor 141 is coupled to the one or more drive shafts 144 by one or more couplers 145 (e.g., 90 degree gearboxes). For example, in the illustrated embodiment the motor 141 can be located on an exterior portion of the housing assembly 170 and provides a rotational motion in the direction indicated by arrows A (shown in FIG. 4). The couplers 145 transmit the rotational motion from the motor 141 to the drive shaft(s) 144, which rotate or drive the first and third rotational devices 143*a* and 143*b* in the direction of arrows B (shown in FIG. 5). Accordingly, the motor 141 causes the drive shaft 144 to drive the rotational devices to move the belts. In the illustrated embodiment, the drive assembly drives the drive shaft 144, which is separate from the spool 130, and does not directly engage and drive the spool 130 to wind or unwind the barrier 110 for movement between the deployed and retracted positions. The rotational motion of the first and third rotational devices 143*a* and 143*b* rotate the belt devices 142 around their respective rotational devices moving the second end 112*b* of the barrier 110 toward and away from the spool 130. As the second end 112*b* of the barrier 110 moves toward and away from the spool, the spool can rotate in the direction of arrows C (shown in FIG. 3), with or against the urging force(s) of the resilient elements discussed above, thereby allowing the barrier 110 to wind off of and onto the spool 130. In the illustrated embodiment, the motor 141 is located on the exterior of the housing assembly 170 where it can be easily serviced and/or replaced.

Additionally, in selected embodiments the use of the one or more couplers 145 can allow the motor 141 to be positioned away from the axis/axes of the one or more shafts 144 and to be coupled to any portion of the one or more shafts 144 (e.g., the motor 141 can be coupled to the one or more shafts anywhere along the length of the one or more shafts). Furthermore, in other embodiments where the motor 141 provides rotational motion, the use of the one or more couplers 145 can allow the axis of rotation of rotational motion provided by the motor 141 to be substantially non-parallel to the axis/axes of rotation of the one or more shafts 144. In still other embodiments, the motor 141 can have other locations and/or can be coupled to one or more rotational devices in a different manner.

In still other embodiments, the drive assembly can have more or fewer rotational devices that are coupled to the motor by a drive shaft and/or coupler. While in the illustrated embodiment, the motor includes an electrical motor, in other embodiments the motor can include other types of motors (e.g., pneumatic motors and/or other types of motion generation devices). For example, in other embodiments the motor can include a gravity type motor that uses a counter weight that is dropped to provide motive force to move the barrier.

FIG. 5 is a partially schematic illustration of a portion of a control system 150 and a power supply 180 of the barrier system 100 shown in FIG. 1. As discussed above, in the illustrated embodiment the control system is operably coupled to a portion of the drive assembly 140 (e.g., the motor 141) and to the external device 195. Additionally, in FIG. 8 the control system 150 and drive assembly 140 are coupled to the power supply 180. In the illustrated embodiment, the power supply is configured to supply electrical power to operate portions of the drive assembly 140 (e.g., the motor 141) and to operate portions of the control system 150.

In FIG. 5, the power supply 180 is coupled to an external power source 106 (e.g., a public power grid, a generator supplying power to a structure, and/or the like). In the illustrated embodiment, the external power source 106 supplies alternating current (e.g., 120V-240V, 50 Hz-60 Hz) to the power supply 180. In FIG. 5, the power supply 180 includes a transformer rectifier 182 for converting alternating current ("AC") to direct current ("DC") and supplies DC to various barrier system components. In other embodiments, the external power source 106 can supply other types of power and/or the power supply 180 can have other configurations.

Additionally, in the illustrated embodiment the power supply includes one or more battery units 181 (e.g., including among other things one or more batteries and/or one or more battery chargers) and the DC from the transformer rectifier 182 can provide power to the battery charger unit(s) to charge the one or more batteries. The one or more battery units 181 can be configured to provide a battery backup feature by supplying power to the barrier system 100 in the event of an external power source failure. In selected embodiments, the power supply 180 (including the battery backup feature) can be used to provide power to other components associated with the barrier system 100. For example, in certain embodiments the barrier system 100 can supply power to the external device 195 from the power supply 180, for example, in the event of a power failure that affects the external device 195.

In other embodiments, the power supply can have other arrangements. For example, in selected embodiments the power supply 180 can be configured to provide both DC and AC power (e.g., via a by-pass circuit with fault protection) to the barrier system 100 and/or other components associated with the barrier system 100. In other embodiments the barrier system 100 does not include a power supply and portions of the barrier system 100 are coupled directly to the power source 106. Although in the illustrated embodiment the power supply is carried in the housing assembly 170 (shown in FIG. 1), in other embodiments the power supply can be carried in other locations and/or can be remotely located.

In the illustrated embodiment the control system 150 includes a computer or computing system configured with instructions to enable and control movement of the barrier. Additionally, in selected embodiments the control system 150 can perform other functions, including supplying electrical power to other components (e.g., the control system 150 can supply power from the power supply 180 and/or the external device 195), monitoring various barrier system 100 components, monitoring external devices, and/or calibrating various components associated with the barrier system 100. For example, in certain embodiments the control system 150 can command the drive assembly 140 to enable movement or to move the barrier toward the deployed and retracted position based on the information provided by the external device 195.

For instance, in selected embodiments where the external device 195 includes a smoke or fire alarm/detector, the control system 150 can be configured to command the drive assembly 140 to enable movement of the barrier 110 toward the deployed position when the detector senses fire, smoke, and/or other types of selected vapor(s) (e.g., is in the second state). The control system 150 can also be configured to command the drive assembly 140 to enable movement of the barrier 110 toward the retracted position, as an example, when the detector does not sense fire, smoke, or selected vapor(s) (e.g., is in the first state), and the barrier 110 is not in the retracted position. Accordingly, the control system 150 can be configured with instructions to deploy the barrier 110 when a vapor and/or fire event is sensed (e.g., when the barrier 110 is not in the deployed position) and retract the barrier 110 when the control system indicates that the vapor and/or smoke event has cleared or other conditions exist wherein the barrier should be retracted.

In selected embodiments, the drive assembly can resist being back-driven so that the drive assembly 140 resists movement when the control system 150 is not commanding movement of the barrier and/or when power is removed from the drive assembly 140. For example, in selected embodiments the motor 141 can include a motor that resists being back-driven. Also, the drive assembly 140 can include various latch components (e.g., controlled by the control system 150) that prevent movement of the barrier until the latch components are released.

In selected embodiments the control system 150 can be configured to perform monitoring, backup, and/or calibration functions. For instance, in selected embodiments the control system 150 can be configured to monitor the health of various components associated with the barrier system 100 and/or report the status of various components associated with the barrier system 100 to other systems 198 (shown in FIG. 8).

For example, the control system 150 can monitor components associated with the barrier system 100 external to the barrier system 100 including the power source 106 and the external device 195. For instance, the control system 150 can monitor the external device 195 by sending a signal to the external device 195 and/or receiving a signal from the external device 195. The signal(s) can be used to determine whether the external device 195 is connected to the barrier system 100, whether the external device is powered, whether the external device has a fault (e.g., is malfunctioning), what fault(s) the external device has experienced, and/or the like.

In other embodiments, the control system 150 can monitor other barrier system 100 components, including components that comprise the barrier system 100 itself. In certain embodiments the control system 150 can monitor the health of the power supply 180, and/or the drive assembly 140. For example, the control system 150 can send and/or receive signals to determine battery charge state(s), whether the battery charging unit(s) is/are working, whether one or more batteries have overheated, and/or the like. In other embodiments, the control system can monitor various components for an over load condition. For example, in selected embodiments the control system 150 can include a sensor and/or circuit protection device (e.g., fuse or circuit breaker) that will disconnect power to the motor in the drive assembly if the motor draws too much electrical current. In still other embodiments the control system 150 can be configured with logic to determine whether a portion of the barrier system 100 has jammed, whether the barrier has experienced an asymmetry, whether the barrier has deployed in response to a barrier deployment command, and/or the like.

The control system 150 can be configured to take corrective action in the event that a component associated with the barrier system 100 is malfunctioning. The control system 150 can be configured to shut down one or more battery chargers in the event that one or more batteries are overheating. Additionally, in certain embodiments the control system 150 can be configured to provide a user or operator with a status of the barrier system 100 or components associated with the barrier system 100 on a barrier system 100 display or to send the status to another system 198 (e.g., a central building monitoring system). This status can include the health of components associated with barrier system 100 components and/or other information, for example, whether a barrier deployment has been commanded by the control system 150 and/or whether an external device 195 configured as a smoke/fire detector has sensed smoke/fire. In selected embodiments, the other system 198 can be configured to provide inputs to the control system 150. For example, in one embodiment the other system 198 can be configured allow a user to command the control system 150 to deploy the barrier.

In certain embodiments, the control system 150 and/or the power supply 180 can be configured to provide various backup functions. For example, in selected embodiments the battery unit(s) 181 of the power supply 180 can provide electrical power to other components associated with the barrier system 100 in the event of a loss of power from the power source 106. For instance, the battery unit(s) 181 can provide power to the control system 150 and/or portions of the drive assembly 140 so that the barrier system 100 can continue to operate with the loss of power from the power source 106. Additionally, in certain embodiments, the battery unit(s) 181 can provide power to the external device 195 if the external device 195 does not have its own power back up. In still other embodiments, the control system 150 can display and/or send a status to another system 198 indicating that power from the power source 106 has been lost.

Despite the power supply 180 and the battery units 181, the control system 150 may still occasionally lose power. The battery units 181 can be exhausted or damaged by a fire or other event, or the connection between the power source 106 and the control unit 150 can become compromised. In the event of a complete power loss it may be advantageous to allow a person, such as an occupant or emergency personnel, to manually lift the barrier and pass from one side to another without rupturing the barrier. Personnel such as firemen, police, or civilian building occupants may need to pass the barrier at times when there is no power to the barrier system 100. In some embodiments a clutch 152 is employed that, when powered, allows movement only upon activation of the drive assembly under the direction of the control system 150. Without power the clutch 152 releases, thereby disengaging the drive assembly, and allows an operator to manually move the barrier between the retracted and deployed position. The barrier system 100 can include one or more handles 200 (FIG. 1) for manual opening and closing of the barrier. The handles 200 can include a switch 202 that is connected to the clutch 152 such that when the switch 202 is depressed the clutch 152 releases to allow manual egress. Accordingly, in some embodiments an operator can approach the barrier, grasp the handle 200, and open the barrier whether the barrier system 100 has power or not. If there is power, the switch 202 and handle 200 will release the clutch 152. If there is no power, the clutch 152 will have already released the barrier and the operator can open or close the barrier. The switch 202 can include a wired or a wireless connection to the clutch 152. The clutch 152 can be located at any appropriate position, and can engage any portion of the barrier system 100, such as the spool 130, the rotational devices 143*a* and 143*c*, the drive shafts 144, the motor, the couplers 145, the belt devices 142, or any other suitable component. In some embodiments, the clutch 152 comprises an electro-magnetic clutch. It will be appreciated that the position and arrangement of the clutch 152 can vary while still allowing manual egress. The clutch 152 can include a clutch, a brake, a friction device, or any other suitable mechanical means to prevent or allow movement of the barrier system 100 while engaged and being driven by the drive assembly and that allows manual movement of the barrier system when released.

In other embodiments, the control system 150 can include a heat-sensitive switch 153 that allows the clutch 152 to release the barrier when a certain temperature is reached. For example, a fusible link, a solder link, or an electric solenoid can be used to release the clutch 152 when a predetermined temperature is reached. The heat-sensitive switch 153 can comprise a plurality of heat-sensitive components placed in various positions relative to the barrier and the passageway. In some embodiments including multiple heat-sensitive switches 153, the clutch can release when a single switch reaches the predetermined temperature. In other embodiments, the clutch 152 can release when a certain percentage of the heat-sensitive switches 153 (e.g., 10%, 50%, 100%) of the switches reach the predetermined temperature. The temperature at which the heat-sensitive switches 153 release the clutch 152 can vary depending on preferences or requirements. For example, the heat-sensitive switches 153 can release when they reach 1,000° C.

Figure 6A:
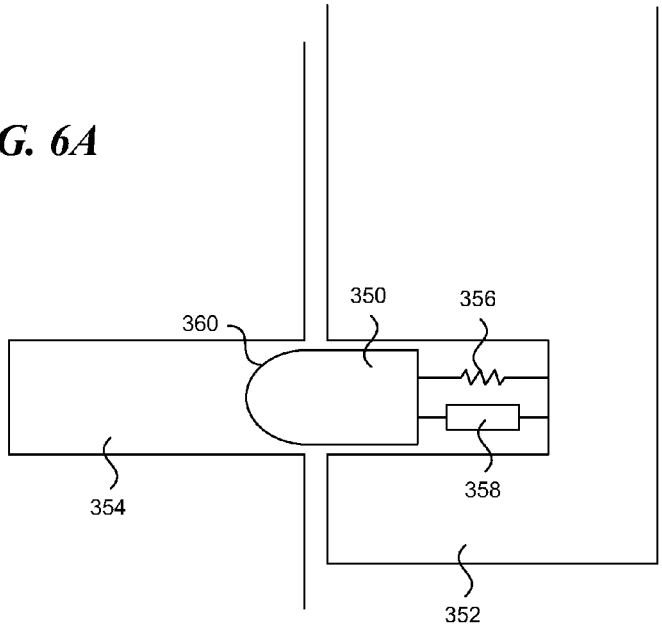
FIGS. 6*a*-6*b* are partially schematic illustrations of a portion of a latch system of the barrier system shown in FIG. 1.
Figure 6B:
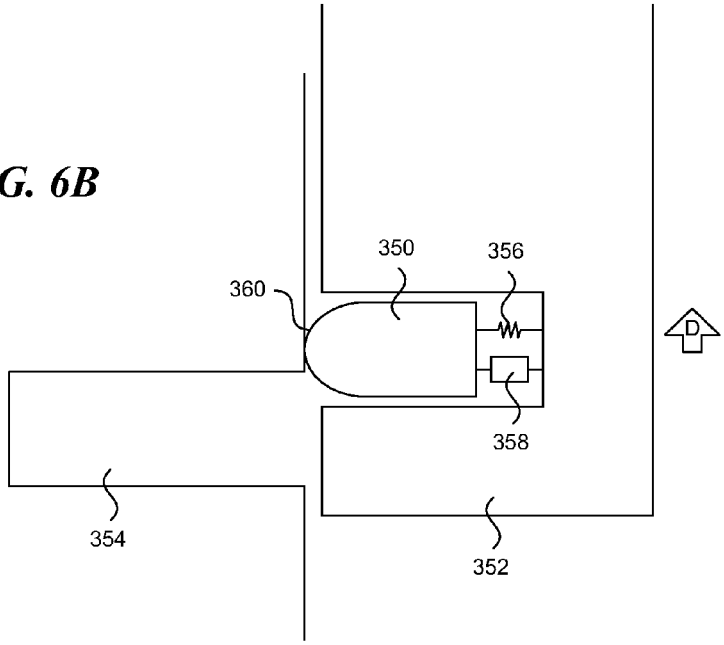

In other embodiments, if power fails when the barrier system 100 has not been deployed (e.g., a power outage when a fire or other smoke and/or vapor related emergency is not present) and the clutch 152 has released, it may be advantageous to prevent the barrier system 100 from deploying from the retracted position. FIGS. 6*a* and 6*b* depict a latch mechanism for retaining the barrier system 100 within the housing assembly 170 to prevent unwanted deployment of the barrier system 100 despite the releasing of the clutch 152 when power fails. In one embodiment, a passive détente 350 extends from a portion of the barrier 352 into a recess 354 when the barrier 110 is in the retracted position. In FIG. 6*b*, the barrier 110 has moved in the direction of arrow D away from the retracted position and the détente 350 has left the recess 354 and is withdrawn into the barrier portion 352 to allow the barrier 110 to deploy. In other embodiments, the position of the détente 350 and recess 354 are reversed, such that the détente 350 is found in the housing assembly 170 (or other supporting structure) and the recess 354 is found in a portion of the barrier 110. For purposes of brevity, however, not all of these configurations are described in detail. In some embodiments, the détente 350 is connected to the barrier portion 352 with a spring 356. The spring 356 can be configured with a varying degree of stiffness to resist unwanted movement while still permitting the barrier system 100 to deploy under normal circumstances. For example, when the drive assembly 140 urges the barrier 110 toward a deployed position the détente 350 does not substantially inhibit the movement of the barrier 110 toward the deployed position, but the spring 356 provides a certain degree of resistance to unwanted movement caused by a power failure in which the clutch 152 is released. It is appreciated that the size, shape, and position of the spring 356 can vary to accommodate barrier systems of differing sizes and shapes.

Other elements can also be positioned between the détente 350 and the barrier portion 352. For example, a sensor 358 configured to detect the position of the détente 350 relative to the recess 354 can be positioned between the détente 350 and the barrier portion 352 and can communicate with the control system 150 via a wireless or a wired connection (not shown). The control system 150 can use the information received from the sensor 358 to adjust how the barrier 110 is deployed. In other embodiments, the sensor 358 can be located inside the recess 354, and can comprise an optical sensor or another suitable type of sensor. An active element (not shown) can also be placed behind the détente 350 to urge the détente 350 into or out of the recess 354.

Figure 7A:
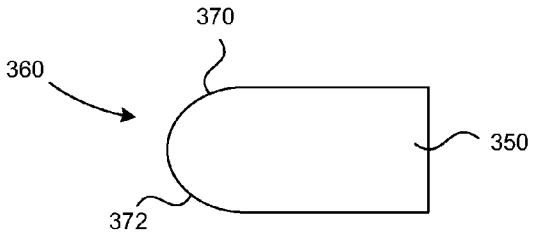
FIGS. 7*a*-7*e* are a partially schematic illustrations of a variety of détentes of the barrier system shown in FIG. 1.
Figure 7B:
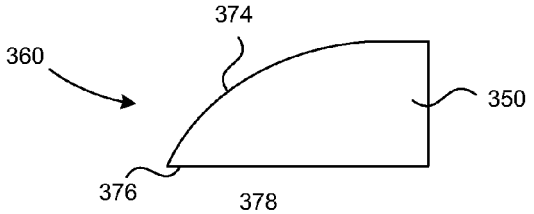
Figure 7C:
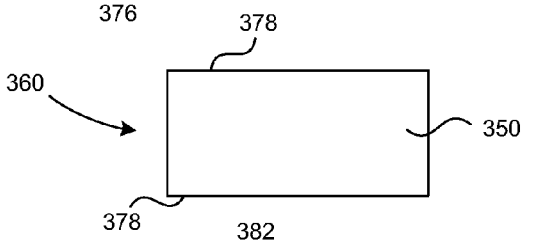
Figure 7D:
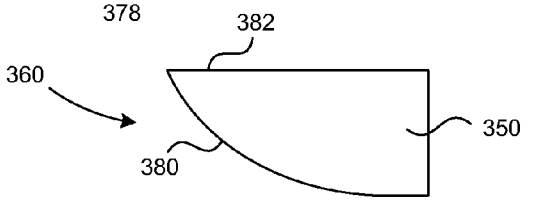
Figure 7E:
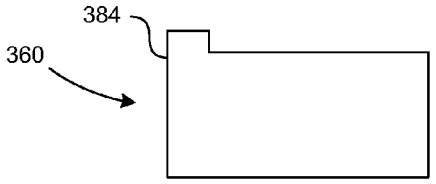

The face 360 of the détente 350 can take several different shapes, to provide different resistance characteristics. FIGS. 7*a*-7*d* illustrate a few embodiments of the détente face 360. It is understood that these depictions are intended to as illustrations and not to limit the scope of the technology. FIG. 7*a* shows a détente 350 where the face 360 includes two sloped surfaces 370 and 372 that permit the détente 350 to enter and leave the recess 354 (shown in FIGS. 6*a* and 6*b*) when forced upward or downward. The sloped surfaces 370 and 372 mitigate the need for a lateral force pulling the détente 350 into the barrier portion 352. FIG. 7*b* depicts another embodiment in which the face 360 includes a sloped surface 374 and a flat surface 376. Similar to a door latch, the sloped surface 374 causes the détente 350 to move laterally into the barrier portion 352 when urged upward, but the flat portion 376 resists lateral movement. Depending on the desired resistance to movement, the détente face 360 can be selected from these various embodiments. FIG. 7*c* illustrates a détente face 360 with flat surfaces 378 on both sides of the détente 350. This détente face structure requires the détente 350 to be retracted from the recess 354 by means other than simply deploying the barrier 110 to push the barrier portion 352 upward or downward. FIG. 7*d* depicts another détente configuration in which the sloped surface 380 and flat surface 382 are reversed. FIG. 7*e* shows a détente face 360 with a key structure 384 that can engage a corresponding negative shape in the recess 354 to provide further resistance to release, if so desired. The latch mechanism therefore prevents unwanted deployment of the barrier 110, but does not substantially interfere with normal, powered operation of the barrier 110. In addition, the clutch 152 enables manual egress through the barrier 110 even when power (including available power backups) fails.

In other embodiments, the barrier system 100 can have other arrangements. For example, although in the illustrated embodiment the second end of the barrier is shown moving in vertical plane between the retracted and deployed positions in other embodiments the barrier system 100 can have other orientations. For example, in selected embodiments the second end of the barrier can move in a horizontal plane between the retracted and the deployed positions. Additionally, although in the illustrated embodiment the barrier is made from a flexible material, in other embodiments the barrier can have other configurations. For example, in other embodiments at least a portion of the barrier can have rigid or semi-rigid segments or portions. Furthermore, although in the illustrated embodiment the barrier system 100 is shown associated with a structure that includes a building, in other embodiments the barrier system 100 can be associated with other structures. For example, in one embodiment the barrier system 100 is positioned to cover an opening in a vehicle such as a ship.

The above-detailed embodiments of the invention are not intended to be exhaustive or to limit the invention to the precise form disclosed above. Specific embodiments of, and examples for, the invention are described above for illustrative purposes, but those skilled in the relevant art will recognize that various equivalent modifications are possible within the scope of the invention. For example, whereas steps are presented in a given order, alternative embodiments may perform steps in a different order. The various aspects of embodiments described herein can be combined and/or eliminated to provide further embodiments. Although advantages associated with certain embodiments of the invention have been described in the context of those embodiments, other embodiments may also exhibit such advantages. Additionally, not all embodiments need necessarily exhibit such advantages to fall within the scope of the invention.

Unless the context clearly requires otherwise, throughout the description and the claims, the words "comprise," "comprising," and the like are to be construed in an inclusive sense as opposed to an exclusive or exhaustive sense, i.e., in a sense of "including, but not limited to." Additionally, the words "herein," "above," "below," and words of similar import, when used in this application, shall refer to this application as a whole and not to any particular portions of this application. Use of the word "or" in reference to a list of items is intended to cover a) any of the items in the list, b) all of the items in the list, and c) any combination of the items in the list.

In general, the terms used in the following claims should not be construed to limit the invention to the specific embodiments disclosed in the specification unless the above-detailed description explicitly defines such terms. In addition, the inventors contemplate various aspects of the invention in any number of claim forms. Accordingly, the inventors reserve the right to add claims after filing the application to pursue such additional claim forms for other aspects of the invention.

We claim:

1. A smoke barrier system usable adjacent to an opening in a structure, comprising:

a flexible smoke barrier having a first end and a second end, the smoke barrier having a deployed position covering the opening and a retracted position not covering the opening;

a handle coupled to the smoke barrier between the first and second ends of the barrier and positioned for engagement by a user to manually move the smoke barrier toward the retracted position;

a drive system that drives the smoke barrier toward each of the deployed position and the retracted position;

a release switch coupled to the smoke barrier and having an activated position and a non-activated position; and a clutch operably interconnecting the drive system and the smoke barrier, the clutch being operably connected to the release switch, the clutch having engaged and released positions, wherein, in the engaged position— the clutch interconnects the drive system with the smoke barrier to allow the drive system to actively drive the smoke barrier to and from the deployed position during a first condition, and the drive system restricts manual movement of the smoke barrier away from the deployed position, and wherein, in the released position— the clutch disconnects the drive system from the smoke barrier during a second condition, and the smoke barrier remains in at least one of the deployed position and an intermediate position between the deployed and retracted positions independent of operation of the drive system; and wherein, with the release switch in the activated position, the clutch is in the released position and the barrier is free to be manually moved away from the deployed position by a user engaging the handle.

2. The smoke barrier system of claim 1 wherein the release switch is wirelessly connected to the clutch.

3. The smoke barrier system of claim 1 wherein the release switch is attached to the handle.

4. The smoke barrier system of claim 1 wherein the clutch is released from the barrier when power is unavailable to the drive system.

5. The smoke barrier system of claim 1 further comprising a control system that directs the drive system to move the barrier between the deployed and retracted positions.

6. The smoke barrier system of claim 1 wherein the clutch is connectable to a source of power, and the release switch in the active position causes the clutch to be in the released position with power provided to the clutch, and wherein the clutch is in the released position with the power to the clutch being interrupted.

7. The smoke barrier system of claim 1, further comprising a heat-sensitive switch coupled to the clutch and configured to cause the clutch to move to the released position for manual movement of the smoke barrier if the heat-sensitive switch is heated to above a predetermined temperature.

8. The smoke barrier system of claim 1 wherein the barrier is configured to prevent migration of smoke or similar vapors from passing through the opening.

9. The smoke barrier system of claim 1, further comprising a biasing manual assist member coupled to the smoke barrier urging the smoke barrier toward the retracted position with the clutch in the released position and during manual movement of the smoke barrier away from the deployed position by a user engaging the handle.

10. The smoke barrier system of claim 1, further comprising a biasing manual assist member coupled to the smoke barrier urging the smoke barrier toward the retracted position with the switch in the activated position and during manual movement of the smoke barrier away from the deployed position by a user engaging the handle.

11. A smoke barrier system usable adjacent to an opening in a structure, comprising:

a flexible smoke barrier having a first end and a second end, the smoke barrier being moveable between a deployed position covering the opening and a retracted position not covering the opening;

a handle coupled to the smoke barrier between the first and second ends of the barrier and positioned for engagement by a user to manually move the smoke barrier toward the retracted position;

a drive system configured to actively drive the smoke barrier toward each of the deployed position and the retracted position;

a release switch moveable between an activated position and a non-activated position;

a clutch operably interconnecting the drive system and the smoke barrier, the clutch being operably connected to the release switch, the clutch being movable between engaged and released positions, wherein, when the clutch is in the engaged position— the clutch interconnects the drive system with the smoke barrier to allow the drive system to actively drive the smoke barrier to and from the deployed position during a first condition, and the drive system restricts manual movement of the smoke barrier away from the deployed position, and wherein, when the clutch is in the released position— the clutch disconnects the drive system from the smoke barrier during a second condition, and the smoke barrier will remain in at least one of the deployed position and an intermediate position between the deployed and retracted positions independent of operation of the drive system; and wherein, when the release switch is moved to the activated position, the clutch moves to the released position and the barrier is free to be manually moved away from the deployed position by a user engaging the handle;

a resilient element coupled to the barrier, wherein the resilient element is configured to bias the smoke barrier toward the retracted position;

a power supply operably connected to the drive system and the clutch and configured to provide power thereto;

a control system connected to the drive system, the clutch and power supply, wherein the control system is configured to monitor an operative health of the drive system and power supply, the control system configured to control movement of the barrier between the deployed and retracted positions in response to a signal from an external fire or smoke detection device.

12. The smoke barrier system of claim 11 wherein the release switch is attached to the handle.

13. The smoke barrier system of claim 11 wherein the clutch moves to the released position when power to the drive system is interrupted.

14. The smoke barrier system of claim 11 wherein moving the release switch to the active position causes the clutch to move to the released position when power is provided to the clutch, and wherein the clutch moves to the released position when the power to the clutch is interrupted.

15. The smoke barrier system of claim 11, wherein the control system is configured to monitor deployment of the barrier and to detect whether the barrier deployment has malfunctioned, and to take corrective action in the event of a barrier deployment malfunction.

16. The smoke barrier system of claim 11, further comprising a heat-sensitive switch coupled to the clutch and configured to cause the clutch to move to the released position for manual movement of the smoke barrier if the heat-sensitive switch is heated to above a predetermined temperature.

17. The smoke barrier system of claim 11, wherein the barrier is positioned to move in a substantially vertical plane or a substantially horizontal plane when the barrier moves between the retracted and deployed positions.

18. The smoke barrier system of claim 11, wherein the power supply is connectable to an external power source, and the power supply further comprises a battery unit configured to provide power to the drive system and the clutch in the event of a power interruption from the external power source.

* * * * *